US007814661B2

(12) United States Patent
Tomassetti

(10) Patent No.: US 7,814,661 B2
(45) Date of Patent: Oct. 19, 2010

(54) RAZOR WITH REPLACEABLE SHAVE PRODUCT DISPENSER CARTRIDGE

(76) Inventor: Louis D. Tomassetti, 2745 E. Atlantic Blvd., Suite 300, Pompano Beach, FL (US) 33062

( * ) Notice: Subject to any disclaimer, the term of this patent is extended or adjusted under 35 U.S.C. 154(b) by 235 days.

(21) Appl. No.: 12/077,767

(22) Filed: Mar. 21, 2008

(65) Prior Publication Data

US 2009/0235530 A1 Sep. 24, 2009

(51) Int. Cl.
*B26B 21/44* (2006.01)

(52) U.S. Cl. ..... 30/41; 30/535; 222/402.13

(58) Field of Classification Search ..... 30/41, 30/535; 222/402.11, 402.13
See application file for complete search history.

(56) References Cited

U.S. PATENT DOCUMENTS 4,791,723 A * 12/1988 Jacobson ..... 30/41
4,813,138 A * 3/1989 Chen ..... 30/41
4,908,945 A * 3/1990 Jacobson ..... 30/41
5,016,351 A * 5/1991 Drahus ..... 30/41
5,070,611 A * 12/1991 Derin et al. ..... 30/41
5,092,041 A * 3/1992 Podolsky ..... 30/41
5,287,624 A * 2/1994 Mondo et al. ..... 30/41
5,655,302 A * 8/1997 Mroczka ..... 30/41
5,701,674 A * 12/1997 Mitchell ..... 30/41
5,855,066 A * 1/1999 Manger ..... 30/41
6,588,631 B2 * 7/2003 Sanchez ..... 222/402.13
7,051,439 B2 * 5/2006 Tomassetti ..... 30/41
2009/0126197 A1 * 5/2009 Tomassetti ..... 30/41
2009/0235530 A1 * 9/2009 Tomassetti ..... 30/41.5

* cited by examiner

*Primary Examiner*—Hwei-Siu C Payer
(74) *Attorney, Agent, or Firm*—Robert M. Downey, P.A.

(57) ABSTRACT

A safety razor having a blade cartridge attached to a neck and a replaceable dispenser cartridge adapted for removable attachment to the razor to thereby form a portion of the razor handle or, alternatively, the entire razor handle. The cartridge includes and interior chamber for containing a shaving conditioning compound (e.g., shave cream or shave gel) and a pressurized dispensing gas. A bottom end of the dispensing cartridge, defining a bottom end of the razor handle, is fitted with a valve to control release of the shaving conditioning compound from the cartridge. An actuator assembly controls operation of the valve to selectively dispense a desired amount of the shaving conditioning compound from the bottom end of the razor handle while the razor is held upright in the normal shaving position.

5 Claims, 4 Drawing Sheets

RAZOR WITH REPLACEABLE SHAVE PRODUCT DISPENSER CARTRIDGE

BACKGROUND OF THE INVENTION

1. Field of the Invention

The present invention relates to safety razors and, more particularly, to safety razors that dispense a shave product such as shave cream, gel or lotion.

2. Discussion of the Related Art

Safety razors for shaving body hair are well known and generally include one or more parallel blades that are encapsulated in a molded cartridge. This molded cartridge presents the blades at an optimal angle to closely remove the desired whiskers or hair while leaving the skin smooth and uncut. The cartridge may be permanently affixed to a disposable handle such that the entire razor, handle and blade cartridge is discarded when the blades become dull. Alternatively, a disposable cartridge is removably attached to a reusable handle, wherein only the blade cartridge is discarded when the blades become dull. Thereafter, a new blade cartridge is attached to the handle for subsequent shaving.

Use of a safety razor requires the person's skin and whiskers to be first moistened and lubricated prior to shaving in order to obtain a close, smooth shave with minimal cuts and irritation to the skin. Thus, the process of wet shaving, (i.e., using a safety razor in combination with water and a shaving cream or gel to moisturize and lubricate the skin surface) has become commonplace. Typically, shaving cream or gel is packaged in a separate container and must first be dispensed into the hands of the user and then applied to the area of skin to be shaved prior to using the razor.

Today's society is increasing mobile and many times a person has a need for carrying personal hygiene items to different locations. This travel need might manifest itself in a short trip to the local gym or a longer trip, such as an out of town business trip. In these instances, the traveler may carry an entire personal care kit, often referred to as a toiletry kit, that is filled with such items as toothpaste, a toothbrush, a safety razor, a pressurized container of shave cream and other personal care products. However, carrying both a razor and a pressurized container of shave cream can be inconvenient. Moreover, current airline travel restrictions imposed by the Transportation Safety Administration (TSA) limit the size of containers that can be packed in carry-on luggage. Specifically, containers holding liquids, gels, creams and paste are limited in size to three ounces or less when carried by the passenger onboard the aircraft. Thus, smaller containers (three ounces or less) for shaving creams, lotions and gels are much more desirable for travel purposes and have been increasing in popularity, particularly among frequent travelers.

Most shave cream and gel products are packaged in metal cans, under pressure, along with a propellant agent to promote discharge from the container upon operation of a valve button. As noted above, the need to carry a separate container of shave cream is inconvenient when traveling, especially on commercial airlines. Additional problems associated with metal shave cream containers include the inconvenience of having to handle two separate items (i.e., a razor and a shave cream dispensing container) when shaving, as well as the added space needed in one's medicine cabinet to accommodate both the razor and the shave cream container. And, because the metal shave cream container is constantly exposed to water and moisture when shaving, the metal container eventually begins to rust. This results in the shaving cream container leaving unsightly rust stains, (i.e., rust rings) on the vanity counter surface and/or shelves in the medicine cabinet.

One safety razor that attempts to alleviate the problems of a separate shave cream container provides an integrated shaving cream dispenser in its handle. However, in order to use the handle dispenser, the razor must be inverted, whereupon the shaving cream is dispensed into the user's opposite hand with the blade cartridge facing down and the blades close to the hand that is holding the razor. The razor must then be turned upright in the user's hand in order to shave. Such a procedure can be awkward and clumsy, especially when the user's hands are wet and covered with shave cream.

Ideally, what is desired is a readily accessible, convenient, and ergonomic shave product containment system integrated with a safety razor that allows the shave product to be dispensed from a lower end of the razor handle with the razor held in the normal upright shaving position. It is further desirable to provide a replaceable cartridge that is filled with a shave cream or gel under pressure, and wherein the pressurized cartridge is structured and disposed for removable attachment to the razor. It is also desirable to have the cartridge form a portion of the handle or the entire shape of the handle of the razor. Finally, it is beneficial if the cartridge is formed and configured to provide an ergonomic and stylish handle on a razor.

SUMMARY OF THE INVENTION

The present invention is directed to a safety razor that includes a replaceable cartridge for dispensing a shaving conditioning compound (e.g., shave cream or shave gel). The cartridge contains the shaving conditioning compound and a pressurized dispensing gas. The cartridge is adapted for removable attachment to the razor, either at the neck or a handle portion. In a preferred embodiment, the cartridge is formed and configured to define a portion of the razor handle or, alternatively, the entire razor handle. Moreover, the cartridge is shaped to provide an ergonomic and stylish handle, either alone or in conjunction with a handle portion of the razor. A bottom end of the cartridge is fitted with a valve for dispensing the shaving conditioning compound downwardly through the valve and into the palm of the user's hand while the razor is held upright (i.e., with the neck and blade cartridge of the razor held higher than the bottom end of the cartridge). A locking mechanism allows the cartridge to be releasably interlocked with a remainder of the razor, as an integral unit, to provide a smooth and uninterrupted ergonomic exterior handle configuration. Various embodiments of an actuator for operating the dispensing valve are disclosed.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, various embodiments of a razor with a replaceable shave product dispenser cartridge are shown.

Figure 1:
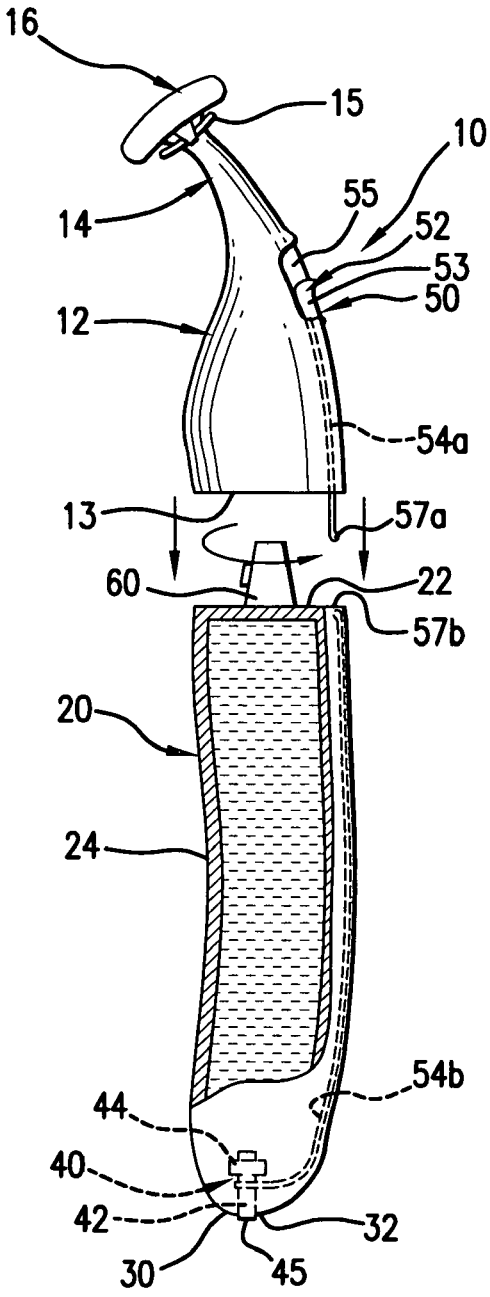
FIG. 1 is a side elevational view, in partial cross-section, showing the replaceable cartridge separated from the razor, with arrows demonstrating the motion for attaching the cartridge to the upper handle portion of the razor.
Figure 2:
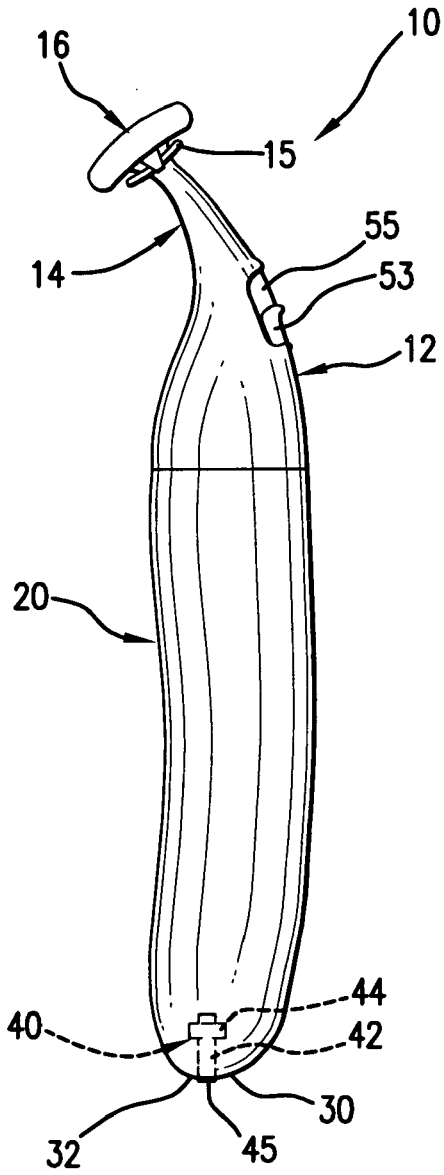
FIG. 2 is a side elevational view of the razor and the dispensing cartridge of FIG. 1 fully assembled as an integral unit.

Referring initially to FIGS. 1 and 2, a first embodiment of a razor and replaceable dispensing cartridge combination is shown and is generally indicated as 10. The combined razor assembly 10 includes a razor body portion 12 extending to an integral neck portion 14. A blade cartridge 16, having one or more blades carried therein, is fitted to a distal end 15 of the neck 14 in a manner that is well known in the art. For example, the blade cartridge 16 may be pivotally attached on the end of arm members or a like structure at the distal end 15 of the neck 14. Moreover, the blade cartridge 16 may be removable and replaceable on the distal end of the neck 14, in a manner that is well known in the safety razor art.

The body portion 12 may be constructed of a molded plastic composition or, alternatively, a metal alloy or a combination of a plastic composition and one or more metal alloys. The bottom end 13 of the body portion 12 is structured and disposed for interlocked receipt of a top end 22 of a dispensing cartridge 20. In each of the embodiments shown throughout the several drawing figures, the dispensing cartridge 20 is formed of a moldable resin, such as a plastic composition, and includes a wall structure 24 that surrounds a hollow interior area defining a pressure chamber 26. The pressure chamber 26 is structured and disposed for containing a charge of a shaving conditioning compound 28 combined with a volume of pressurized gas for forcing the compound 28 out from the dispensing cartridge 20 during use, as described more fully hereinafter. Other means for forcing the shaving conditioning compound out from the dispensing cartridge 20 are contemplated and include, but are not limited to, a collapsible bag containing the shaving conditioning compound and surrounded by a pressurized gas, as well as a piston that is moveable in response to a force of pressurized gas to urge the shaving conditioning compound out from a dispensing opening of the cartridge. It should be noted that use of a piston requires an interior pressure chamber having a cross section of uniform dimension throughout the distance of piston travel. A cylindrical canister, such as a metal can, is particularly ideal for the piston type dispensing system. Accordingly, the present invention contemplates the use of a replaceable metal canister containing a charge of the shaving conditioning compound and a volume of pressurized gas, wherein a piston is employed for forcing the shaving conditioning compound out from the dispensing canister. In this example, the canister containing the shaving conditioning compound is removably inserted within the ergonomic handle of the razor and replaced when empty. It is noted that use of a collapsible bag or a piston dispensing system allows the pressurized gas and charge of shaving conditioning compound to remain separated within the pressure chamber 26.

A lower end 30 of the dispensing cartridge 20 is formed with an opening 32 communicating with the interior pressure chamber 26. A valve 40 is fitted to the lower end 30 of the dispensing cartridge, preferably within the interior pressure chamber 26, and in sealed relationship to the opening 32 in order to contain the charge of shaving conditioning compound 28 and the volume of pressurized gas within the interior pressure chamber. In a preferred embodiment, the valve 40 is provided with a hollow valve stem 42 extending from a valve body 44 and at least partially through the opening 32 formed in the bottom of the dispensing cartridge 20. An open distal end 45 of the valve stem 42 communicates with an exterior of the dispensing cartridge and is able to move axially and/or laterally relative to the valve body 44 and opening 32.

An actuating assembly 50 is operatively engaged with the valve 40 for operating the valve from a normally closed position to a release position in order to dispense the shaving conditioning compound 28, with the assistance of the pressurized gas, from the dispensing cartridge 20. In several embodiments, the actuating assembly 50 includes one or more elongate bands connecting between an actuator member 52 and the valve stem 42. As seen in the embodiment of FIGS. 1 and 2, the actuator member 52 is a slidable button 53 that moves from a normally relaxed, OFF position and through a short range of movement, within a channel or grove 55 formed in the body portion 12, to a momentary dispensing position. In the embodiment of FIGS. 1 and 2, a first elongate band 54*a* connects to the sliding button 53 and extends within an interior channel of the body portion 12 and outwardly from the bottom end 13 of the body portion terminating a distal end 57*a*. A second elongate band 54*b* connects to the valve stem 42 and extends through an interior channel formed in the dispensing cartridge 20. When the dispensing cartridge 20 is attached to the body portion 12, as depicted by the arrows in FIG. 1, the distal end 57*a* of the first elongate band 54*a* operatively engages an upper distal end 57*b* of the second elongate band 54*b*. Thereafter, with the dispensing cartridge 20 attached to the main body 12, sliding movement of the actuator button 53 from the OFF position to dispensing position serves to pull both the first elongate band 54*a* and the second elongate band 54*b* upwardly, in the direction of sliding movement of the actuator button. This short movement of the first and second elongate bands serves to apply a tugging action on the valve stem 42, moving the valve stem laterally to actuate the valve 40 and dispense the shaving conditioning compound 28 outwardly from the open end 45 of the hollow valve stem 42.

As seen in FIG. 1, the top end 22 of the dispensing cartridge 20 is provided with a locking hub 60 that is structured and disposed for interlocking receipt within a congruently shaped cavity formed in the bottom end 13 of the body portion 12. A short twisting motion, as depicted by the curved arrow in FIG. 1, serves to lock the hub 60 within the cavity of the hollow body portion 12, thereby securing the dispensing cartridge 20 to the body portion 12, as a unitary structure (see FIG. 2). The combined exterior configuration of the body portion 12 and the dispensing cartridge 20, as seen in FIG. 2, provides a unitary, ergonomic razor handle. When the dispensing cartridge 20 is fully exhausted of the shaving conditioning compound 28 contained within the interior pressure chamber 26, the dispensing cartridge is removed from the body portion, by twisting in the opposite direction. The empty dispensing cartridge 20 can then be discarded and replaced with a new dispensing cartridge that is filled with the charge of shaving conditioning compound.

Figure 3:
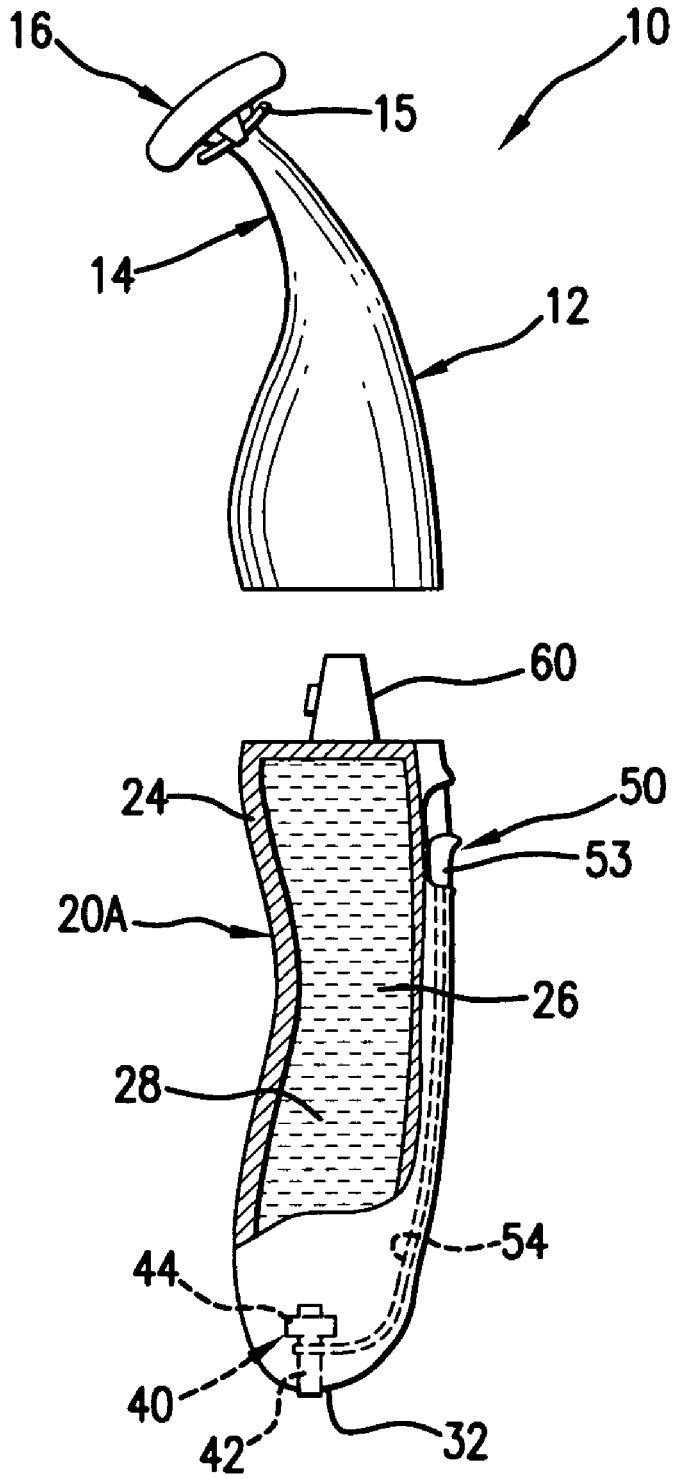
FIG. 3 is a side elevational view, in partial cross-section, showing another embodiment of the invention with the dispensing cartridge separated from a remainder of the razor.

FIG. 3 shows an alternative embodiment from that of FIGS. 1 and 2, wherein the sliding dispenser actuating button 53 is provided on the dispensing cartridge 20A. In this particular embodiment, a single elongate band 54 connects between the sliding actuator button 53 and the valve stem 42. The dispensing operation is performed in the same manner as described above in connection with the first embodiment of FIGS. 1 and 2. Similarly, attachment and removal of the dispensing cartridge 20A from the body portion 12 of the razor is achieved in same manner described above in connection with the embodiment of FIGS. 1 and 2.

Figure 4:
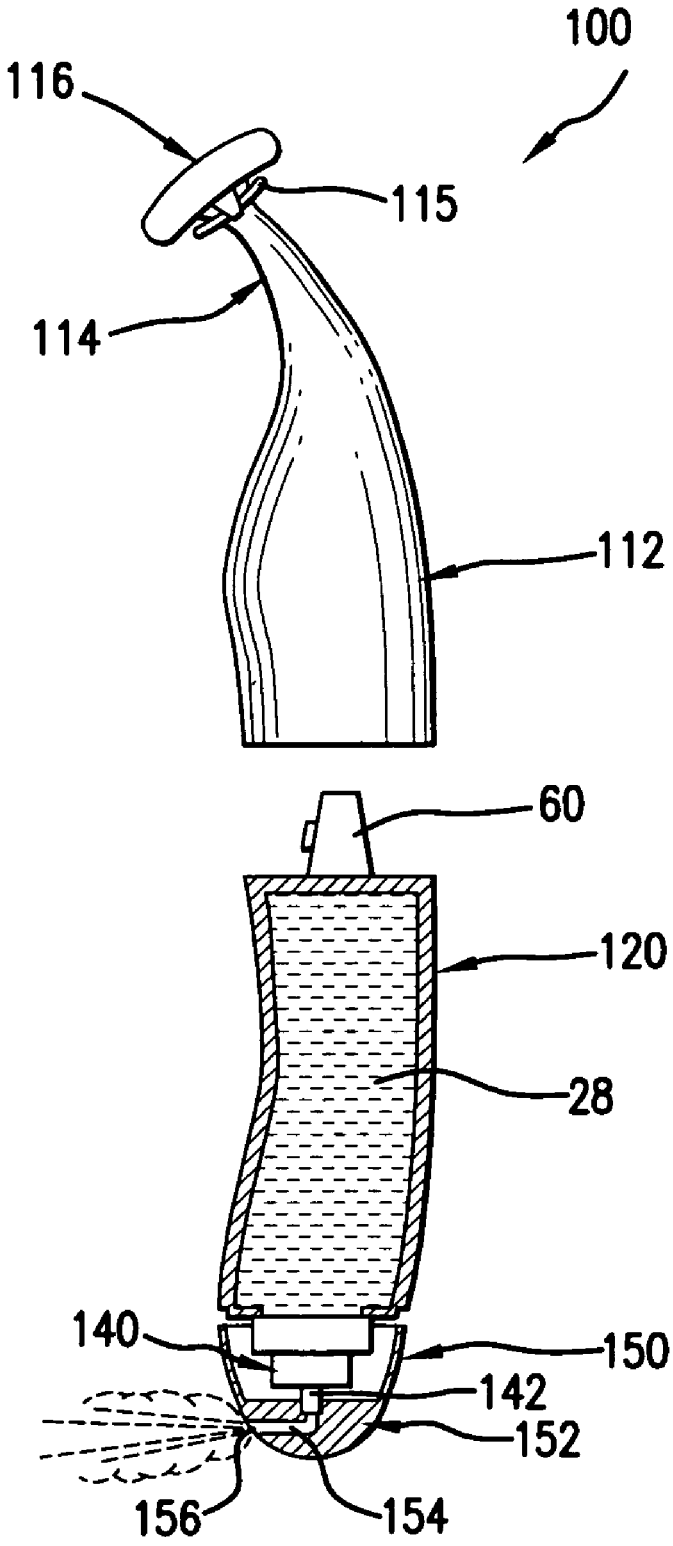
FIG. 4 is a side elevational view, in partial cross-section, illustrating yet a further embodiment of the invention with the dispensing cartridge shown separated from a remainder of razor.

FIG. 4 illustrates a further embodiment of the razor and dispending cartridge combination generally indicated as 100. In this embodiment, the body portion 112, neck 114, distal end 115, and blade cartridge 116 are essentially the same as described above in connection with FIGS. 1 and 2. The dispensing cartridge 120 removably attaches to the body portion 112 to provide a unitary, integral and ergonomic handle. While the locking hub 60 shown in the embodiments of FIGS. 1-4 is a preferred method of removably attaching the dispensing cartridge to the body portion, in accordance with a best mode of the invention, it is recognized that other releasable attaching structures and methods can be adopted for use in releasably attaching the dispensing cartridge to the body portion and, such other structures and methods are fully contemplated within the spirit and scope of the invention.

In the embodiment of FIG. 4, the actuating assembly 150 is defined by a cap 152 that fits over the valve 140. The exterior configuration of the cap is such that it maintains the overall aesthetic and ergonomic configuration of the dispensing cartridge 120 and overall handle configuration. The cap 152 is structured and disposed to operatively engage the valve stem 142 such that movement of the cap 152, by pressing the end of the cap against the palm of the hand or a rigid surface, causes a physical displacement of the valve stem 142 to thereby operate the valve 140 and dispense the shaving conditioning compound 28 outwardly through the valve stem 142. The cap 152 is formed to include a duct 154 disposed in fluid communication with the valve stem 142 for directing the dispensed shaving conditioning compound 28 outwardly from an opening 156 in the cap upon application of the external force to the cap while the razor is held generally upright.

Figure 5:
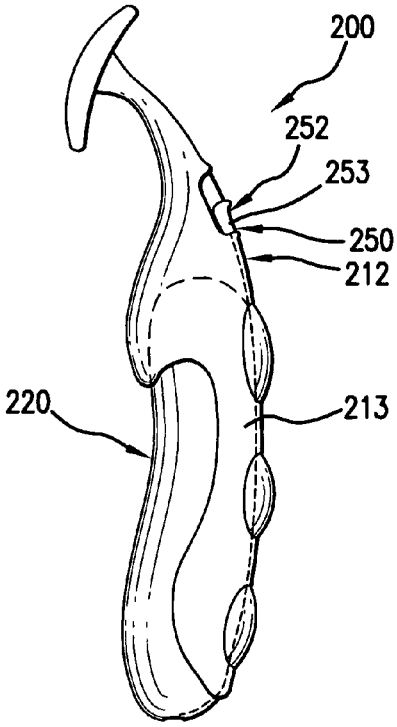
FIG. 5 is a side elevational view showing yet a further embodiment of the razor and dispensing cartridge combination, with the cartridge attached to the handle portion of the razor to form an integral, ergonomic handle.
Figure 6:
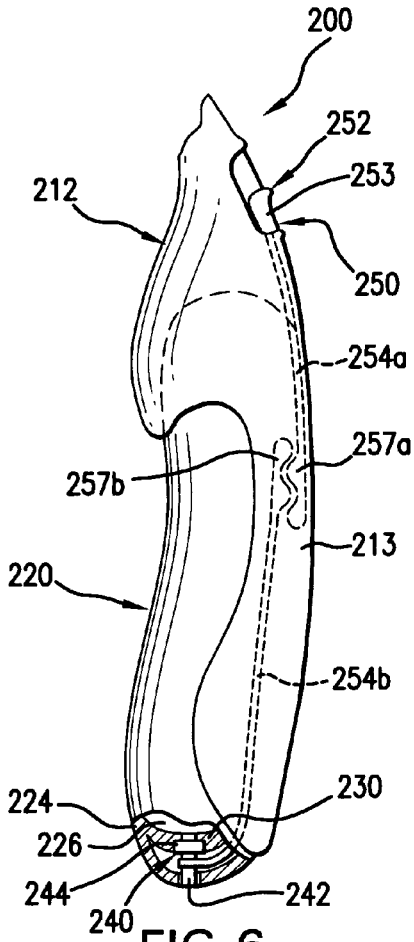
FIG. 6 is an isolated side elevational view, in partial cross-section, of the embodiment of FIG. 5, showing the dispensing valve and actuator assembly between the razor handle and the removable dispensing cartridge.

FIGS. 5 and 6 illustrate yet a further embodiment of the invention. In this particular embodiment, the body portion 212 of the razor is formed to provide a portion of the handle as a partially open shell 213. The handle shell 213 is structured and configured for releasable, interlocking receipt of a dispensing cartridge 220 therein. When the dispensing cartridge 220 is received within the handle shell 213, the combined components form a unitary, ergonomic handle of the razor 200. The dispensing cartridge 220 is structured in a similar manner as the described above in connection with the previous embodiments, and includes a molded structure, preferably from a plastic resin composition, that forms the wall structure 224 surrounding an interior pressure chamber 226. Similar to the embodiment of FIGS. 1 and 2 described above, a valve 240, including a valve body 244 and valve stem 242, is fitted to a bottom end 230 of the dispensing cartridge 220 in fluid communication with the shaving conditioning compound 28 contained within the interior pressure chamber 226. An actuator member 252, such as a slide button 253, is provided on the body portion 212 and connects with a first elongate band 254*a* that extends at least partially through the handle shell 213. A second elongate band 254*b* connected to the valve stem 242 and extending upwardly within a channel or groove formed in the dispensing cartridge includes a distal end 257*b* that is formed and configured for operative, releasable engagement with a lower distal end 257*a* of the first elongate band 254*a* when the dispensing cartridge 220 is operatively received and interlocked within the handle shell 213, as seen in FIG. 6.

Figure 7:
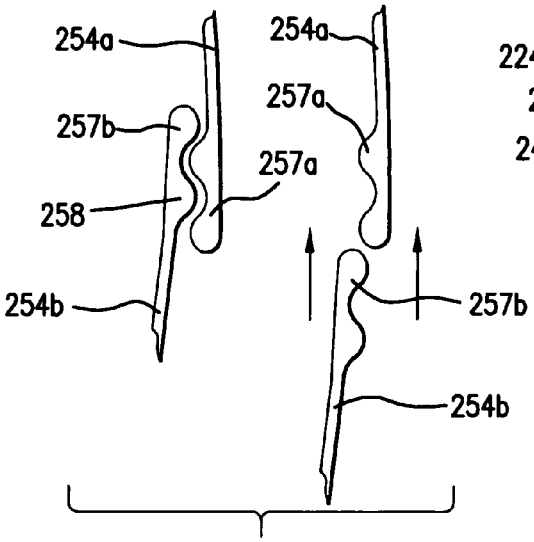
FIG. 7 is an isolated view showing the cooperating components of the actuator assembly between the replaceable dispensing cartridge and the handle portion of the razor and the manner of releasable engagement of these components upon removal and replacement of dispensing cartridges on the razor.

FIG. 7 illustrates an example of a preferred embodiment of the structure of the distal ends 257*a*, 257*b* of the first and second elongate bands 254*a*, 254*b* of the actuating assembly 250 of the embodiment of FIGS. 5 and 6. Specifically, the distal ends 257*a*, 257*b* are formed with a series of bumps or protrusions 258 that provide for cooperative, releasable engagement of the distal ends when the dispensing cartridge 220 is inserted into the handle shell 213, as depicted by the motion of the arrows in FIG. 7. When operatively positioned, as seen in FIG. 6, the second elongate band 254*b* moves with the first elongate band 254*a*. More specifically, sliding upward movement of the actuating button 253 serves to pull the first elongate band 254*a* upwardly in the direction of the sliding movement of the actuating button. Likewise, the operative interconnection of the first elongate band 254*a* with the second elongate band 254*b* serves to pull the second elongate band upwardly in the same direction of travel, causing a tug force to be applied on the valve stem 242. This tug force moves the valve stem 242 laterally to a displaced position that operatively opens the valve 240 for dispensing the contained shaving conditioning compound 28 outwardly from the valve stem 242 and the bottom end of the dispensing cartridge. As can be appreciated with reference to FIGS. 5 and 6, the dispensing operation can be easily performed with a single hand, while the razor is held in the normal position for shaving, with the thumb placed on the slide button 253. Upon urging the slide button 253 upwardly, using the thumb, the shaving conditioning compound 28 is dispensed from the bottom end of the razor handle (i.e. the bottom of the dispensing cartridge) while holding the razor assembly 200 in an upright position, as seen in FIG. 5. This avoids the necessity of using two hands to dispense shaving cream or gel as well as avoiding the need to change the position of the razor in the user's hand (i.e. inverting the razor) in order to dispense the contained shaving conditioning compound.

While the invention has been shown and described in accordance with several preferred and practical embodiments, it is recognized that departures from the instant disclosure are fully contemplated within the spirit and scope of the invention which is not to be limited except as set forth in the following claims as interpreted under the doctrine of equivalents.

What is claimed is:

1. A razor comprising:

a body portion including a neck;

a blade cartridge movably connected to said neck;

a dispensing cartridge removably attachable to said body portion to define at least a portion of a handle of said razor, and said dispensing cartridge including an interior pressure chamber for holding a charge of a shaving conditioning compound and a pressurized dispensing gas, and said dispensing cartridge further including a lower end defining a bottom of said handle, and an opening in said lower end communicating with said interior pressure chamber;

said dispensing cartridge further including a valve at least partially received within said opening and normally disposed to prevent release of the charge of shaving conditioning compound and the pressurized gas out through the opening, and said valve being operable from a normally closed position to a release position for dispensing the shaving conditioning compound, with the assistance of the pressurized gas, from said dispensing cartridge;

an actuating assembly operatively engaged with said valve for selectively operating said valve from the normally closed position to the release position, said actuating assembly including an actuating member including a moveable button that is operatively moveable between a normally relaxed OFF position and a momentary dispensing position, and said actuating member being urged to the normally relaxed OFF position;

said moveable button being positioned in spaced relation from said valve and said opening in said bottom of said handle and at an upper portion of said handle and positioned and disposed for operation by a user's thumb while holding the razor in an upright position for shaving; and at least one elongate band extending from said valve at said bottom of said handle to said upper portion of said handle, and said at least one elongate band being structured and disposed for physically displacing said valve upon movement of said actuating member from said normally relaxed OFF position to said momentary dispensing position, and said at least one elongate band being further structured and disposed to allow said valve to return to the normally closed position upon said actuating member returning to the normally relaxed OFF position.

2. The razor as recited in claim 1 wherein said actuating member is on the dispensing cartridge.

3. A razor comprising:

a body portion including a neck;

a blade cartridge movably connected to said neck;

a dispensing cartridge removably attachable to said body portion to define at least a portion of a handle of said razor, and said dispensing cartridge including an interior pressure chamber for holding a charge of a shaving conditioning compound under pressure, and said dispensing cartridge further including a lower end defining a bottom of said handle, and an opening in said lower end communicating with said interior pressure chamber;

said dispensing cartridge further including a valve fitted to said dispensing cartridge in sealed relation to said opening and structured and disposed to prevent release of the charge of shaving conditioning compound out through the opening, and said valve being operable from a normally closed position to a release position for dispensing the shaving conditioning compound from said dispensing cartridge; and an actuating assembly operatively engaged with said valve for selectively operating said valve from the normally closed position to the release position, said actuating assembly including an actuating member including a moveable button that is operatively moveable between a normally relaxed OFF position and a momentary dispensing position, and said actuating member being urged to the normally relaxed OFF position;

said moveable button being positioned in spaced relation from said valve and said opening in said bottom of said handle and at an upper portion of said handle and positioned and disposed for operation by a user's thumb while holding the razor in an upright position for shaving; and at least one elongate band extending from said valve at said bottom of said handle to said upper portion of said handle, and said at least one elongate band being structured and disposed for physically displacing said valve upon movement of said actuating member from said normally relaxed OFF position to said momentary dispensing position, and said at least one elongate band being further structured and disposed to allow said valve to return to the normally closed position upon said actuating member returning to the normally relaxed OFF position.

4. The razor as recited in claim 3 wherein said dispensing cartridge and said body portion of said razor are formed and configured to provide a unitary handle of said razor.

5. The razor as recited in claim 4 wherein said unitary handle provided by said dispensing cartridge and said body portion has an ergonomic shape.

* * * * *